United States Patent [19]

Bernard

[11] Patent Number: 4,533,026

[45] Date of Patent: Aug. 6, 1985

[54] DEVICE WHICH CAN BRAKE AND/OR STOP A LOAD SECURED TO IT AND WHICH FALLS, NOTABLY AN ANTI-FALL SAFETY DEVICE

[75] Inventor: Georges C. Bernard, Uriage, France

[73] Assignee: G.A.M.E.S., Uriage, France

[21] Appl. No.: 433,300

[22] Filed: Oct. 7, 1982

[30] Foreign Application Priority Data

Oct. 7, 1981 [FR] France ..... 81 18908

[51] Int. Cl.[3] ..... B65H 59/16

[52] U.S. Cl. ..... 188/184; 188/65.2; 188/65.4; 254/391; 254/402; 254/406

[58] Field of Search ..... 254/391, 402, 405, 406; 188/65.4, 65.5, 188, 65.2, 184; 182/235, 5, 6, 7

[56] References Cited

U.S. PATENT DOCUMENTS

| | | | |
|---|---|---|---|
| 411,869 | 10/1889 | Mitchell et al. | 188/65.4 |
| 811,191 | 1/1906 | Whiteside | 254/402 X |
| 1,406,560 | 2/1922 | Houghton | 254/406 |
| 2,164,894 | 7/1939 | Bentley | 254/406 |
| 2,937,853 | 5/1960 | Jackson, Jr. | 188/188 X |
| 4,077,094 | 3/1978 | Swager | 24/134 R |

FOREIGN PATENT DOCUMENTS

| | | | |
|---|---|---|---|
| 2149047 | 3/1973 | France . | |
| 117046 | 8/1946 | Sweden | 254/405 |
| 1131310 | 10/1968 | United Kingdom | 188/65.4 |

*Primary Examiner*—George E. A. Halvosa

*Attorney, Agent, or Firm*—Beveridge, DeGrandi and Weilacher

[57] ABSTRACT

A load carrying device, movable along a rope, has a casing formed of two cheeks, a shaft supported on the casing, and a pulley supported on the shaft. Two diverters are disposed on opposite cheeks of the casing so a rope enters the device on one diverter, passes about a portion of the circumference of the pulley, and exits the device on the other diverter. The casing has a closed position where the cheeks are axially adjacent and an open position where the cheeks are spaced apart along the shaft so that a rope may be inserted in the device. The cheeks have stops which limit their translational movement from the closed position and limit their rotational movement when rope tension tends to move the diverters away from each other. Centrifugal force of pulley rotation causes a pawl to lock the pulley against rotation.

11 Claims, 3 Drawing Figures

II
III
23
27
3
2
13
35
12
1
7
4
8
37
42
32
45
31
46
11
28
6
II
III

DEVICE WHICH CAN BRAKE AND/OR STOP A LOAD SECURED TO IT AND WHICH FALLS, NOTABLY AN ANTI-FALL SAFETY DEVICE

This invention relates to a device which can brake and/or stop a load secured to it and which falls, utilizable in particular as an anti-fall device by a person carrying out hazardous jobs or activities during which they may fall.

An anti-fall device is already known which can be mounted on a rope and comprises a grooved wheel round which a rope is wound over part of its circumference and two exit pulleys, with a swivelling component to which the load is secured and which can press the rope against one of the exit pulleys and with the said grooved wheel having pawls which lock this wheel under the effect of centrifugal force. The main drawback to this known device consists in the fact that the rope has to be threaded into this device by one of its ends and this device has to be moved along the rope to the spot where it is intended to use it.

The purpose of the present invention is to remedy this drawback in particular. It thus proposes a device which can be easily fitted along a rope or cable at exactly the spot where it is required, and the device is also easy to remove. In addition this device is simple, easy to make and provides all the necessary safety in use.

The device according to the invention is of the type that can be fitted along a rope or cable which is preferably taut. It comprises, on the path of the cable or rope, a first rope diverter round which the rope is diverted, a pulley having on its periphery an annular groove with a V cross-section opening outwards in which the rope is wound over part of its circumference, and a second rope diverter round which the said rope is diverted. This device also comprises a casing which carries the shaft of the said pulley (round which it rotates) and the said diverter elements, with this pulley carrying a pawl system which, when acted on by centrifugal force, engages with the casing to lock the said pulley in rotation in at least one direction.

According to this invention the said casing comprises two cheeks placed on either side of the said pulley and supporting the ends of this pulley's shaft, with at least one of the cheeks being capable of being moved along and/or round the pulley shaft in such a way that the said cheeks can take up a first position relative to each other in which they are joined, the casing being closed, and a second position in which they are apart, the casing being open, so leaving a free space between them enabling the said rope to be placed in the pulley groove and on the diverters at any spot along its length.

In a particularly advantageous embodiment of the device according to this invention, each of the said cheeks bears respectively one of the rope diverter elements, with the cheeks comprising corresponding means acting as stops for rotation round the pulley shaft, which means, when the casing is closed, are made to engage together by the tension of the said rope so as to keep the cheeks joined together.

According to this invention the said cheeks may also comprise corresponding means acting as stops against translation along the shaft of the said pulley, which means, when the casing is closed, engage together so as prevent the cheeks sliding apart along the pulley shaft.

In a particularly advantageous embodiment the said cheeks may comprise corresponding shoulders designed to form the said means acting as rotational stops, and the said means acting as translational stops may be formed by at least one mortice and tenon system designed into the cheeks.

In a preferred embodiment of the said casing, each cheek may comprise a radial bearing surface for the other cheek and the rope diverter on it protrudes and forms a rotational stop with a corresponding shoulder existing on the other cheek.

It is possible in this embodiment to arrange for the said rope diverter and the said shoulder forming a rotational stop to comprise respectively a corresponding tenon and mortice or lug and slot forming the stop for translation along the pulley shaft when the casing is closed.

In order to guide the said rope the said rope diverter elements may comprise a groove which this rope bears against.

If this groove is deep enough its sides may form the said translational stop system thanks to the rope tension.

In order to fasten the said load to the casing it can be arranged for the said cheeks to each comprise a hole, which holes correspond when the casing is closed; a load securing element, like a snap hook, can be fitted through these holes so that this securing element advantageously locks the said casing in its closed position.

In order to lock the said grooved pulley in rotation it should preferably be arranged for at least one of the cheeks to comprise notches acting as stops for the aforesaid pawl system.

In accordance with a special manufacturing method the said cheeks can be produced directly by moulding with, for example, aluminium as the material. In this case it can be arranged for the rope diverters and the shoulders on the cheeks to be an integral part of these cheeks.

Furthermore, as the said cheeks can have corresponding structures, it can be arranged for them to be identical. They must then be mounted on the pulley shaft in opposition to each other. Thus the manufacturing costs of the device can be cut down to a considerable extent.

The present invention will be more clearly understood on studying a rope-mounted anti-fall safety device to which a person can be attached, described as a non-restrictive example and illustrated in the drawings, in which.

Figure 1:
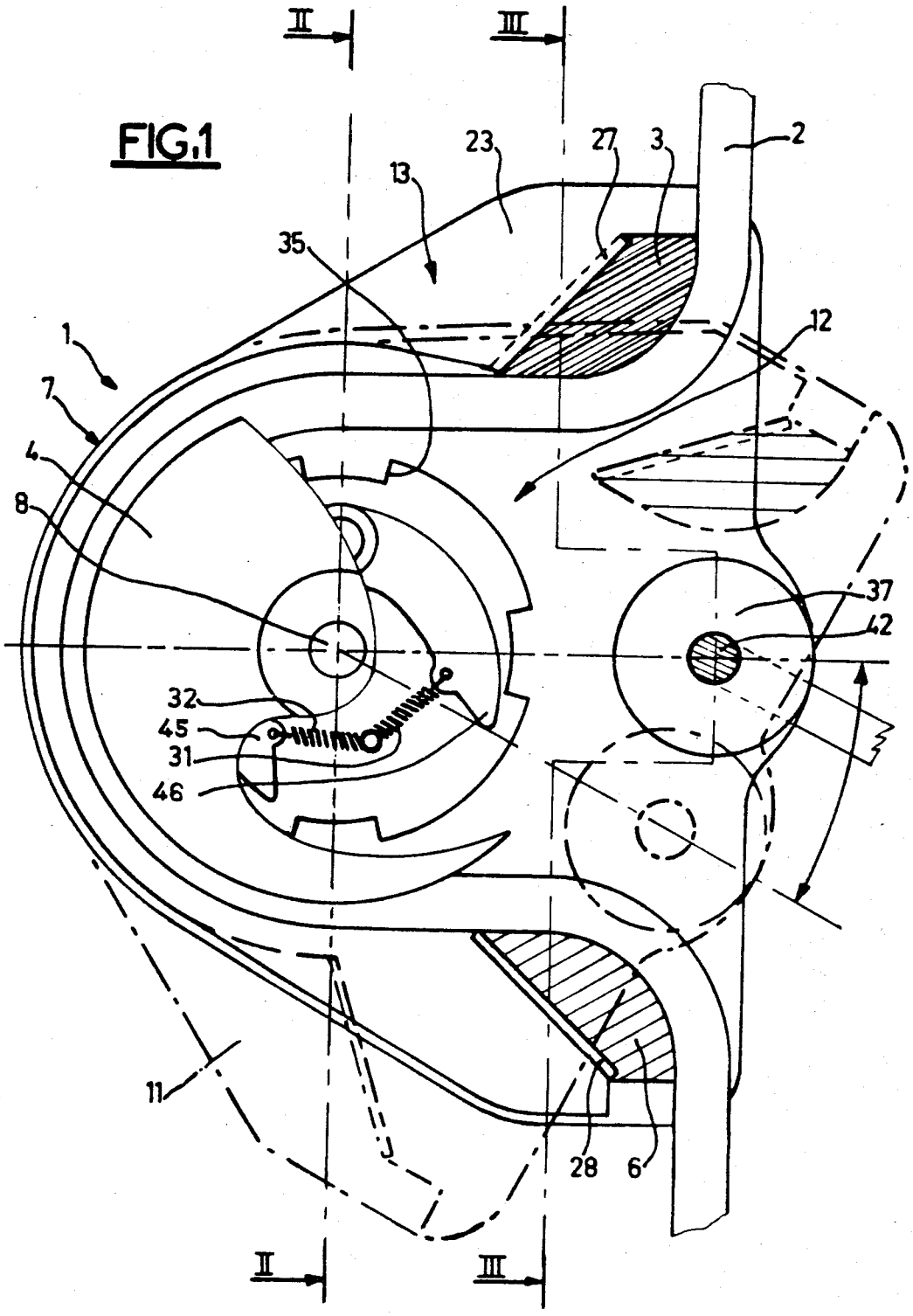
FIG. 1 shows a radial section through the rope plane along section I—I shown in FIG. 2.

The anti-fall safety device shown in the figures and marked overall by reference 1 is fitted at a point on a vertical rope 2 of any length, the top end of which is fastened to a fixed point and the bottom end of which carries a weight so that the rope 2 is taut.

In the path followed by the rope inside the device 1 this device comprises a rope diverter 3 which diverts the rope along a roughly horizontal direction, a pulley 4 having on its outer periphery an annular groove 5 of V-cross-section, the V opening outwards, in which the rope is wound over roughly half its circumference and a diverter 6 round which the rope 2 is again diverted. The rope 2 therefore forms an omega-shaped open loop inside the device 1.

The device 1 comprises a casing marked overall by the reference 7, with this casing carrying the rotational shaft 8 of the pulley 4, which is mounted on the latter by means of a rolling bearing, for example a ball bearing, 9, and bearing the rope diverters 3 and 6.

The casing 7 consists of two cheeks 10 and 11 placed on either side of the pulley 4 and bounding a hollow inside space 12 open on the opposite side to this pulley 4 so as to let the rope 2 through; these cheeks 10 and 11 bear against each other along a plane 47 perpendicular to the rotational shaft 8 and coinciding with the plane of the rope 2.

The cheeks 10 and 11 are identical and are mounted in opposition to each other.

The cheeks 10 and 11 comprise hubs 13 and 14 respectively which carry the shaft 8 on each side of the bearing 9, through holes 13*a* and 14*a*, with the inside radial annular faces 15 and 16 of the hubs 13 and 14 bearing against the inner race of bearing 9 and holding it in place axially. The hubs 13 and 14 comprise on the outer side recesses 17 and 18 having a larger diameter than the shaft 8; at its ends this shaft 8 carries retaining rings 19 and 20 which are located at a distance from the shoulders 21 and 22 formed at the bottom of recesses 17 and 18.

The cheeks 10 and 11 respectively carry the rope diverter elements 6 and 3 which project above the radial plane 47 inside cheeks 11 and 10 respectively; the diverters 3 and 6 form an integral part of cheeks 11 and 10 respectively.

The cheeks 10 and 11 comprise bosses 23 and 24 respectively which extend up to the radial plane 47 and which respectively butt against the diverter elements 3 and 6 along surfaces 25 and 26 which are roughly axial to the shaft 8. Bosses 23 and 24 respectively form rotational stops for the diverter elements 3 and 6 in the direction in which they separate under the effect of the tension of the rope 2 corresponding to a rotation of the cheeks 10 and 11 round the shaft 8 in the opposite direction.

On their faces acting as stops against which the diverter elements 3 and 6 bear respectively, the bosses 23 and 24 of cheeks 10 and 11 are provided with tenons 27 and 28 which enter mortices 29 and 30 made in the diverter elements 3 and 6.

On one of the sides the pulley 4 carries a pawl system consisting of two pawls 45 and 46 swivelling and fitted in opposition to each other; springs 31 and 32 act on these pawls in a direction which brings them nearer to the shaft 8.

The cheeks 10 and 11 comprise, round the hubs 13 and 14 internal recesses 33 and 34 on the edge of which axially extending notches 35 and 36 are made. In the example shown the pawls 45 and 46 are placed on the side of recess 33 so that, when acted on by centrifugal force, the end of one of the pawls, when the pulley 4 rotates in one direction, or the end of the other pawl when this pulley rotates in the other direction, can engage with the notches 35 when the pulley 4 attains a preset speed. As the two cheeks 10 and 11 have notches 35 and 36 respectively, the pawls may both be on one side of the pulley or the other, or one on one side and the other on the other.

On the side to which the inner space 12 of the casing 7 opens out the cheeks 10 and 11 comprise bosses 37 and 38 respectively located at a distance from the diverter elements 3 and 6; these bosses 37 and 38 bear against each other along the radial plane 47. Holes 40 and 41 are made in these bosses 37 and 38 which correspond to each other and through which a snap hook 42 passes to which a person can be attached. The minimum diameter of the holes 40 and 41 is slightly greater than the diameter of the snap hook 42 so that the cheeks 10 and 11 cannot swivel with respect to each other round the rotational axis 8. In the example the holes 40 and 41 are aligned with the sections of the rope 2 outside the device.

Figure 2:
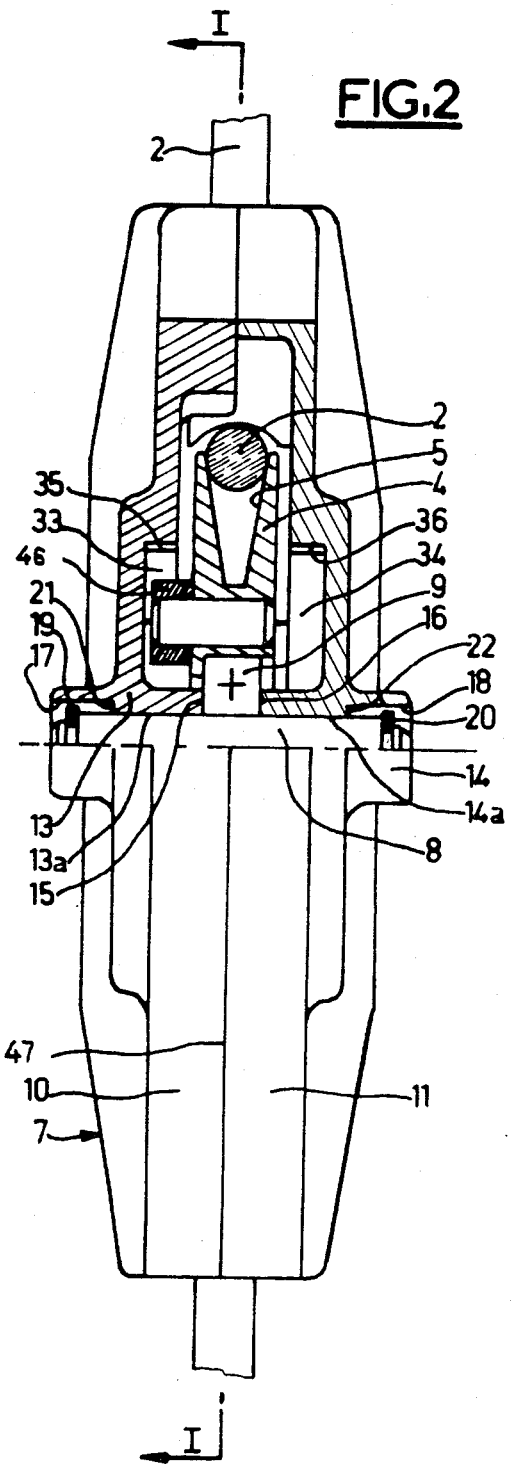
FIG. 2 shows the device of FIG. 1 in an axial half-section II—II and half external view.
Figure 3:
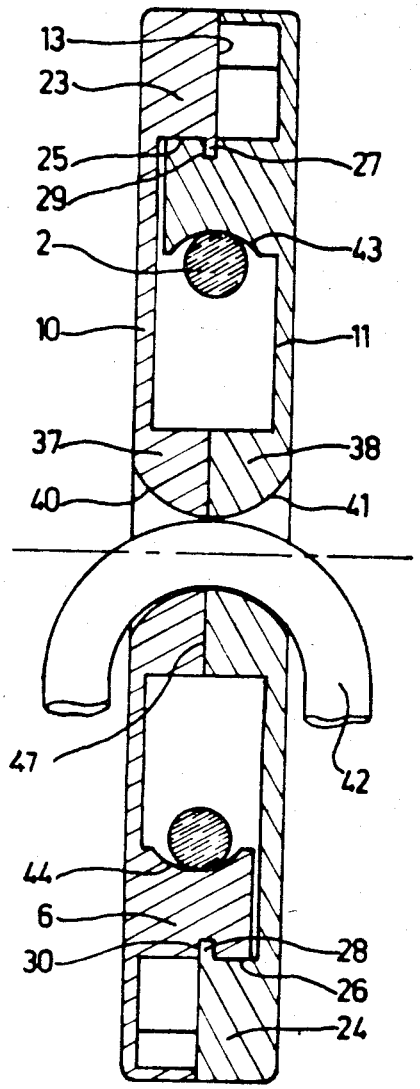
FIG. 3 shows the device of FIG. 1 in a section partially offset along III—III.

As can be seen in FIG. 2, the groove 5 of the pulley 4 has a V-shaped cross-section so that the rope 2 bears against the sides of this groove. The rope diverter elements 3 and 6 also comprise grooves 43 and 44 the bottom of which supports the rope 2, these grooves being, in the rope direction, shaped to follow approximately an arc of a circle covering roughly 45° on the opposite side to surfaces 25 and 26.

It transpires from the preceding description that the cheeks 10 and 11 are joined in rotation round pulley 4 shaft 8 owing to the tension in the rope 2 which presses the diverter elements 3 and 6 and the cheeks 10 and 11 respectively onto the bosses 23 and 24 forming the rotational stops of these cheeks and that the mortice-and-tenon systems 27, 29 and 28, 30 prevent any movement of the cheeks 10 and 11 along the rotational axis 8 of the pulley 4 with respect to each other. In addition the snap hook 42 forms a safety element locking the casing formed by the cheeks 10 and 11.

The anti-fall device 1 described above possesses a special advantage concerning the installation of the rope 2 in the groove 5 of the pulley 4 and on the bearing surfaces 43 and 44 of the diverter elements 3 and 6 by opening the casing 7.

Thus, in order to open the casing 7 the following operations are performed.

If one is fitted, the snap hook 42 is removed. The cheeks 10 and 11 are swivelled round the rotational shaft 8 of the pulley 4 in a direction which separates the diverter elements 3 and 6 from the shoulders 23 and 24, with the inside space 12 bounded by the cheeks 10 and 11 allowing the diverter elements 3 and 6 to be moved in this space. During this rotation the cheeks 10 and 11 slide over one another along the radial joint plane 47.

Thus the tenons 27 and 28 are disengaged from the corresponding mortices 29 and 30.

Cheek 11 has been shown in a chain-dotted line in FIG. 1 swivelled round with respect to cheek 10.

Subsequently cheeks 10 and 11 are slid in opposite directions along shaft 8 of pulley 4 until the shoulders 21 and 22 of the hubs 13 and 14 are stopped axially by the retaining rings 10 and 20 on the ends of the shaft 8.

When the cheeks 10 and 11 are moved apart as has just been described a space is freed between these cheeks which is big enough to radially insert the rope 2 through the space between these cheeks at any point on the rope 2 by moving the rope sideways. This rope can then be placed in the groove of the pulley 4 and round the diverter elements 3 and 6 passing between the end of diverter element 3 and cheek 10 and between the end of diverter element 6 and cheek 11 so that the rope is positioned in the grooves 43 and 44 of the diverter elements 3 and 6.

When the rope is arranged thus the cheeks 10 and 11 are brought into contact along the radial plane 47. They are swivelled round the shaft 8 in opposite directions and in the opposite direction so that the diverter elements 3 and 6 butt against the corresponding bosses 23 and 24, placing the tenons 23 and 24 in the corresponding mortices 29 and 30.

The snap hook 42 is then installed through the holes 40 and 41 in the cheeks 10 and 11, with the casing 7 being thus locked in the closed position. The device is then ready to use and a person can attach themselves to the snap hook 42.

In order to remove the rope 2 from the device 1 the snap hook is removed, the casing 7 is opened by swivelling the cheeks 10 and 11 and separating them and the rope 2 is removed through the space made between the cheeks 10 and 11.

The device works as follows.

When the person falls they pull down on the device 1. The rope 2 slides over the rope diverter elements 3 and 6 and the pulley 4 rotates. As the speed of falling increases one of the pawls 45 and 46 is made by centrifugal force to engage with one of the notches 35 and locks the pulley 4 in rotation. The rope then slides in the groove 5 of the pulley 4.

Since the groove 5 in the pulley 4 has a V-shaped cross-section, and if the rope 2 is wound round a large enough angle of this pulley, the rope is pressed into the groove, and after a certain slipping or falling distance the device is locked to the rope 2 and the person is halted in their fall.

As the pulley 4 is provided with a system of two opposed pawls 45 and 46, the device 1 can be installed independently in either direction on the rope 2. It may be noted that, when the person is attached and hanging from the device 1, it is impossible for them to remove the device 1 from the rope as they would have to be able to remove the snap hook 42 in order to do so.

As they have just been described the cheeks 10 and 11 can be manufactured by casting and, as they are identical, only one mould need be made.

The present invention is not limited to the above example. Thus it is possible to arrange for the diverter elements and the stop shoulders to be separate and fixed onto the cheeks and, in particular, for the diverter elements to consist of pulleys, with the stop elements in this case being designed on the two cheeks in such a way as to correspond to each other. It would also have been possible to provide a system directly on the cheeks and remaining in place for locking the casing in the closed position and possibly taking the form of a clip. Furthermore, if the grooves 43 and 44 of the diverter elements 3 and 6 are deep enough, it is possible to conceive of eliminating the mortice-and-tenon or lug and slot systems. For, as the rope 2 is taut, the walls of these grooves 43 and 44 may be enough to hold the cheeks 10 and 11 in position axially on the shaft 8, with the snap hook 42 forming an adequate means of locking the casing 7. Many othe variants are also possible without going outside the framework of this invention.

I claim:

1. A device which is movable along a preferably taut rope and is connectible to a load, said device being operable when the load falls to brake and/or stop the falling movement of the load comprising:

a casing having two opposite cheeks, a shaft wxtending through the casing and supported by said cheeks, a pulley supported on the shaft and located in the casing between said cheeks, a pawl means operable in response to centrifugal force of pulley rotation to lock the pulley against rotation relative to the casing in at least one direction, a first diverter mounted solely on one of said cheeks and a second diverter mounted solely on the other of said cheeks of the casing, each diverter extending from its respective cheek toward the other cheek, said diverters being disposed so that a rope which is diverted by one of said diverters passes about a portion of the circumference of said pulley and is diverted by the other diverter, at least one of said cheeks being movable on said shaft between a closed position of the casing in which the cheeks are axially adjacent and an open position of the casing in which the cheeks are spaced apart along said shaft, said cheeks comprising means which are operable to be engaged with each other to limit the relative rotational movement of the cheeks about the axis of said shaft when the diverters tend to move away from each other in response to tension of the rope, and also are operable to limit the relative translational movement of the cheeks along the axis of said shaft, said engageable means being operable when said cheeks are in the closed position, said device being constructed so that a rope can be introduced in the casing between its cheeks and disposed on said pulley and said diverters at any point of its length when said casing is in said open position, and said cheeks are maintained together by said engageable means in response to tension of the rope when said casing is in said closed position.

2. The device of claim 1 wherein said engageable means includes shoulders on said cheeks which are operable as rotational stope.

3. The device of claim 2 wherein said shoulders are provided respectively with mortises and tenons which are engaged when the casing is in its closed position to limit translation of said cheeks along said shaft.

4. The device of claim 1 wherein each engageable means comprises a shoulder which is engaged by the diverter of the opposite cheek for limiting rotational movement of said cheeks about said shaft.

5. The device of claim 4 wherein the shoulders and diverters are provided with mortises and tenons which are engaged when the casing is in its closed position to limit translation of said cheeks along said shaft.

6. The device of claim 1 wherein the engageable means for preventing translational movement of said cheeks along said shaft includes a projection on one cheek, said other cheek having a recess for receiving said projection.

7. The device of claim 1 wherein the diverters are provided with grooves for receiving the rope.

8. The device of claim 1 wherein the cheeks are provided with holes which, when the casing is in its closed position, are aligned with each other to receive a locking element which locks the casing in its closed position.

9. The device of claim 8 wherein said holes receiving said locking element extend between said diverters.

10. The device of claim 1 wherein the pawl means includes pawls mounted on the pulley and notches provided in the casing for engagement by the pawls.

11. The device of claim 1 wherein said cheeks are identical and are mounted in opposite directions.

* * * * *

UNITED STATES PATENT AND TRADEMARK OFFICE

CERTIFICATE OF CORRECTION

PATENT NO. : 4,533,026

DATED : August 6, 1985

INVENTOR(S) : Bernard G. Cuny

It is certified that error appears in the above-identified patent and that said Letters Patent is hereby corrected as shown below:

On the title page, Inventor's name should read

-- Bernard G. Cuny --.

Signed and Sealed this

*Twelfth* Day of *November 1985*

[SEAL]

*Attest:*

DONALD J. QUIGG

*Attesting Officer*

*Commissioner of Patents and Trademarks*